United States Patent [19]

Miura et al.

[11] Patent Number: 4,496,102

[45] Date of Patent: Jan. 29, 1985

[54] CLEANING APPARATUS

[75] Inventors: Takao Miura, Urawa; Isao Miura, Kawaguchi, both of Japan

[73] Assignee: Miura Machinery Works Co., Ltd., Kawaguchi, Japan

[21] Appl. No.: 391,661

[22] Filed: Jun. 24, 1982

[30] Foreign Application Priority Data

Sep. 8, 1981 [JP] Japan ..... 56-133373

[51] Int. Cl.[3] ..... B05B 3/02; B05B 3/04

[52] U.S. Cl. ..... 239/227

[58] Field of Search ..... 239/227

[56] References Cited

U.S. PATENT DOCUMENTS

| | | | |
|---|---|---|---|
| 3,464,632 | 9/1969 | Bristow | 239/227 |
| 3,584,790 | 6/1971 | Bonfield | 239/227 |
| 3,637,138 | 1/1972 | Rucker | 239/227 |

FOREIGN PATENT DOCUMENTS

| | | | |
|---|---|---|---|
| 0075613 | 9/1949 | Norway | 239/227 |

*Primary Examiner*—John J. Love
*Assistant Examiner*—Michael J. Forman
*Attorney, Agent, or Firm*—Jordan and Hamburg

[57] ABSTRACT

A cleaning apparatus including an ejector assembly (52, 54, 62, 64) with cleaning jets which rolls in a circular path around a housing (40) at a speed which is adjustable independent of the pressure of the liquid issuing from the cleaning jets of the ejector assembly. The liquid is fed under a predetermined high pressure to an ejection port (12*c*) in a stationary support member (12) through a first distribution path (12*b*) to form a driving jet, as well as to the ejector assembly through a second distribution path (10*c*, 42*a*, 42*b*, 50*a*, 50*b*, 54*a*, 54*b*, 52*b*) for forming the cleaning jets. The driving jet drives an impeller (20) whose rotation is transmitted to the housing by a gearing (28, 32, 16, 14), thereby moving the ejector assembly around the housing. The rotating or movement of the ejector assembly is provided by engagement of bevelled teeth (12*a*, 52*a*) on the support member and ejector assembly. The rotating speed of the ejector assembly is determined by a replaceable nozzle (38) having a selected diameter of nozzle hole or a nozzle housing (36') having an adjustable nozzle needle (68) therein. Either one of each shaft (10, 50) of the apparatus and a sleeve (42, 54) slidably engaged therewith is formed with an annular recess (50*c*) for receiving an improved sealing which ensures sealing between the shaft and the sleeve against a substantial magnitude of liquid pressure.

16 Claims, 6 Drawing Figures

CLEANING APPARATUS

BACKGROUND OF THE INVENTION

The present invention relates to an apparatus for cleaning the interior of such an enclosure as a tank by jets of liquid under high pressure.

Tanks in various industries, such as for brewage or fermentation, are generally cleaned by an apparatus which causes a nozzle housing into rotation about its axis while rotating nozzles about a predetermined axis to jet liquid under high pressure to a uniform distribution. Both the rotation of the housing and that of the nozzles share the pressure of the liquid. For example, the housing is driven by an impeller disposed in an internal passageway of the apparatus and the nozzles are moved each in the opposite direction to the ejection of liquid therefrom based on the reaction to the ejection.

However, the force of ejection from the nozzles is reduced by a proportion consumed by the rotation of the housing and that of the nozzles. Also, the nozzles are individually angled 90° so as to achieve the necessary reaction for rotation so that the resulting stream of liquid from each nozzle does not converge but becomes scattered. Meanwhile, because the rotation speeds of the housing and nozzles are commonly proportional to the amount of pressurized liquid supply, it is impossible to control only the pressure of liquid jets from the nozzles while maintaining the rotation speeds at values optimum for cleaning. This limits the applicable range of such a cleaning apparatus.

An implement heretofore known for eliminating this problem comprises a damper or the like which is installed within the housing to apply a predetermined torque to the housing. This implement suffers from severe drawbacks, however, that the apparatus as a whole grows bulky, intricate and, accordingly, expensive, and that the apparatus is inapplicable to food industry due to possible leakage of oil out of the damper or the like.

SUMMARY OF THE INVENTION

A cleaning apparatus for an enclosure embodying the present invention includes a stationary support member, a first shaft securely mounted to the support member and formed with an axial bore from one end toward the other end, and an impeller journalled to said other end of the shaft and opposed by an ejection port which is formed in the support member. The ejection port is communicated to a source of pressurized liquid supply through the axial bore by a first distribution path which branches off the axial bore in the shaft. A hollow cylindrical member is mounted on the support member to be rotatable about a longitudinal axis of the shaft. A second shaft is fixedly connected to the cylindrical member such that its axis extends perpendicularly to the axis of the first shaft, while an ejector assembly is rotatably mounted on the second shaft and includes at least one ejection port. The ejection port is communicated to the source of pressurized liquid supply through the axial bore by a second distribution path which also branches off the axial bore in the shaft. Rotation of the impeller is transmitted to the cylindrical member by transmission means so that the ejector assembly is caused into revolution about the axis of the first shaft through the cylindrical member and the second shaft. Means is provided for causing the ejector assembly into rotation about the axis of the second shaft simultaneously with the revolution around the axis of the first shaft.

A cleaning apparatus causes an ejector assembly to roll on a circular path around a housing at a speed which is adjustable independently of a pressure of cleaning jets of liquid from the nozzle assembly. The liquid is fed under a predetermined high pressure to an ejection port in a stationary support member through a first distribution path to form a driving jet, as well as to the ejector assembly through a second distribution path for forming the cleaning jets. The driving jet drives an impeller whose rotation is transmitted to the housing by a gearing, thereby moving the ejector assembly around the housing. The rolling movement of the ejector assembly is provided by engagement of bevelled teeth on the support member and ejector assembly. The moving speed of the ejector assembly is determined by a replaceable nozzle having a selected diameter of nozzle hole or a nozzle housing having an adjustable nozzle needle therein. Either one of each shaft of the apparatus and a sleeve slidably engaged therewith is formed with an annular recess for receiving an improved sealing which ensures sealing between the shaft and the sleeve against a substantial magnitude of liquid pressure.

It is accordingly an object of the present invention to provide a cleaning apparatus for an enclosure which can be driven at a controllable speed optimum for a specific application with the pressure of a cleaning jet of liquid controlled to a value.

It is another object of the present invention to provide an improved effective liquid-tight sealing between a shaft and a cylindrical bearing member slidable on the shaft, which prevents leakage of a liquid against a substantial magnitude of pressure under which the liquid may be fed.

It is another object of the present invention to provide a generally improved cleaning apparatus for an enclosure.

Other objects, together with the foregoing, are attained in the embodiments described in the following description and illustrated in the accompanying drawings.

DESCRIPTION OF THE PREFERRED EMBODIMENTS

While the cleaning apparatus for an enclosure of the present invention is susceptible of numerous physical embodiments, depending upon the environment and requirements of use, substantial numbers of the herein shown and described embodiments have been made, tested and used, and all have performed in an eminently satisfactory manner.

Figure 1:
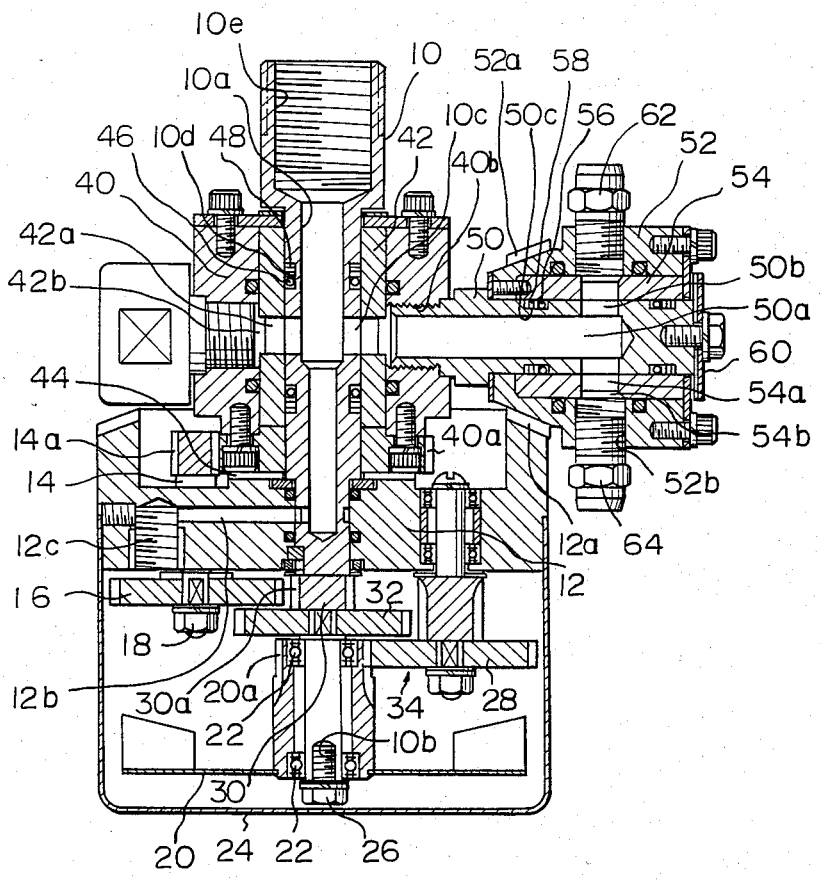
FIG. 1 is a section of a cleaning apparatus for an enclosure embodying the present invention.

Referring to FIG. 1 of the drawings, the cleaning apparatus has at its center an upright fixed shaft 10 whose outside diameter is progressively and stepwisely reduced from the upper end to the lower end. A bore 10*a* extends axially throughout a substantial length of the shaft 10 from the upper end toward the lower end. A support member in the form of a disc 12 is fastened by a nut (not shown) to the shaft 10 adjacent to the bottom of the bore 10*a*. The disc 12 is machined to have bevelled teeth 12*a* on its top along the circumference, and a radial passageway 12*b* communicating with the bore 10*a* at its inner end. A shaft 14 is rotatably supported by the disc 12 through a bearing (not shown) and formed with teeth 14*a* therearound. A spur gear 16 is fixedly mounted by a set screw 18 to that lower end of the shaft 14 which projects downwardly from the disc 12.

An impeller 20 having bearings 22 thereinside is journalled to the lower end of the shaft 10 and isolated from the outside by a cover 24, to which the disc 12 is mounted. Separation of the impeller 20 from the shaft 10 is prevented by a bolt 26 which is screwed into a threaded bore 10*b* at the lower end of the shaft 10. A hub (not designated) of the impeller 20 is formed with teeth 20*a* which mesh with a spur gear 28. A shaft 30 is rotatable integrally with a spur gear 32, which meshes with the spur gear 28, and formed with teeth 30*a* which mesh with the spur gear 16. The spur gear 28 engaged by the teeth 20*a* of the impeller 20 is rotatably supported by the disc 12. The spur gears 28 and 32 belong to a gear reducing mechanism generally designated by the reference numeral 34, the gear 32 constituting the last gear reduction element.

Figure 2:
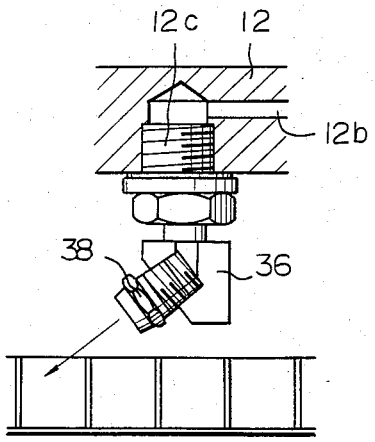
FIG. 2 is a fragmentary section of the cleaning apparatus shown in FIG. 1.

As shown in FIG. 2, a nozzle housing 36 is screwed into a threaded hole or a first ejection port 12*c* which is formed in the disc 12 to communicate with the radial passageway 12*b*. A nozzle 38 is removably screwed into the nozzle housing 36. The nozzle 38 having a nozzle hole of a selected diameter ejects a jet of liquid under high pressure toward the impeller 20 by an amount determined by the nozzle hole diameter, as will be described later.

The shaft 10 is drilled with holes 10*c* which communicate with a generally intermediate portion of the axial bore 10*a*.

A hollow cylindrical housing 40 is rotatably coupled over the shaft 10 through a sleeve 42. The housing 40 is formed on its periphery with teeth 40*a* which are meshed with the teeth 14*a* of the shaft 14, so that the housing 40 is rotatable together with the impeller 20 through the gearing. The housing 40 is rotatably supported by a thrust bearing 44 which is located between the housing 40 and the disc 12. The shaft 10 is formed with annular recesses 10*d* at axially spaced locations on its outer periphery, each of which receives therein an O-ring 46 and a plurality of backup rings 48 to establish liquid-tight sealing for the housing 40.

The sleeve 42 is provided with an annular recess 42*a* in its inner periphery communicated with the ports 10*c* and holes 42*b* contiguous with the annular recess 42*a*. The rotatable housing 40 has a threaded hole 40*b* which communicates with the holes 42*b* and receives therein a shaft 50 about which a transverse rotary housing or a second hollow cylindrical housing 52 is rotatable. A bore 50*a* extends axially through the shaft 50 which is in communication with the bore 10*a* of the shaft 10 via the holes 42*b*, annular recess 42*a* and holes 10*c*. Passageways 50*b* extend radially outward from the bore 50*a* throughout the shaft 50. The shaft 50 has annular recesses 50*c* at axially spaced positions on its outer periphery which faces the inner periphery of a sleeve 54, which is integral with the transverse housing 52. Each annular recess 50*c* receives therein an O-ring 56 and a plurality of backup rings 58 for ensuring liquid-tight sealing.

The transverse housing 52 is formed with bevelled teeth 52*a* on its outer periphery which mesh with the bevelled teeth 12*a* of the disc 12. A washer 60 is coupled to the outermost end of the shaft 50 to retain the housing 52 on the shaft 50. With this arrangement, the transverse housing 52 will roll on the outer periphery of the disc 12 in accordance with the rotation of the vertical housing 40, while rotating about the shaft 50. Nozzles 62 and 64 are received respectively in threaded holes or a second ejection port 52*b* of the transverse housing which are in turn communicated to the passageways 50*a* and 50*b* via an annular recess 54*a* and holes 54*b* formed through the sleeve 54, so that liquid under high pressure can be ejected from the individual nozzles 62 and 64 as will appear later. The sleeve 54, housing 52 and nozzles 62 and 64 make up an ejector assembly.

In use, the cleaning apparatus is connected at a threaded upper end 10*e* of the shaft 10 to a piping (not shown) which leads to a source of pressurized liquid supply. Liquid under high pressure entering the axial bore 10*a* of the shaft 10 is partly directed to the nozzles 62 and 64 via the ports 10*c*, and the recess 54*a* and holes 54*b* of the sleeve 54, and partly directed to the nozzle 38 via the passageway 12*b* of the disc 12 and nozzle housing 36. Whereas the liquid reached the nozzles 62 and 64 are ejected to the outside as cleaning jets, the liquid reached the nozzle 38 is jetted toward the impeller 20 for driving the various rotary elements of the apparatus sequentially.

As the driving jet from the nozzle 38 causes the impeller 20 into rotation about the axis of the shaft 10, the teeth 20*a* drive the spur gear 16 via the gear reducing mechanism 34 thereby driving the shaft 14 supported by the disc 12. The shaft 14 in turn rotates the vertical housing 40 in a predetermined direction through its teeth 14*a* which are in mesh with the teeth 40*a*. Then, the transverse housing 52 accompanies the rotating vertical housing 40 through the shaft 50 which is rigid with the vertical housing 40, while rolling on the disc 12 due to the meshing engagement of its teeth 52*a* with the teeth 12*a* of the disc 12. As a result, the nozzles 62 and 64 on the transverse housing 52 individually eject the liquid throughout the 360° range of rotation of the vertical housing 40 and throughout the 360° range of rotation of the transverse housing 52. Thus, the apparatus can clean the whole interior of a desired tank by the jets evenly distributed in convergent streams.

It will be seen that the cleaning jets from the nozzles 62 and 64 can have a pressure optimum for scatter-free convergent flows because it is needless to take into consideration the forces for driving rotary elements of the apparatus. The driving jet from the nozzle 38 is directed toward the impeller independently of the cleaning jets from the nozzles 62 and 64. The nozzle 38 is replaceable with another having a different hole diameter to control the pressure of the driving jet separately from the pressure of the cleaning jets, so that the apparatus can be driven at a speed adequate for a desired application of the apparatus.

Furthermore, the gearing of the apparatus is simple in construction, easy to manufacture and, therefore, low in cost. Also, the apparatus can find extensive applications even to food and other industries which reject introduction of oil into tanks, because each transmission element will not require any supply of lubricant if its material is suitably selected.

Figure 3:
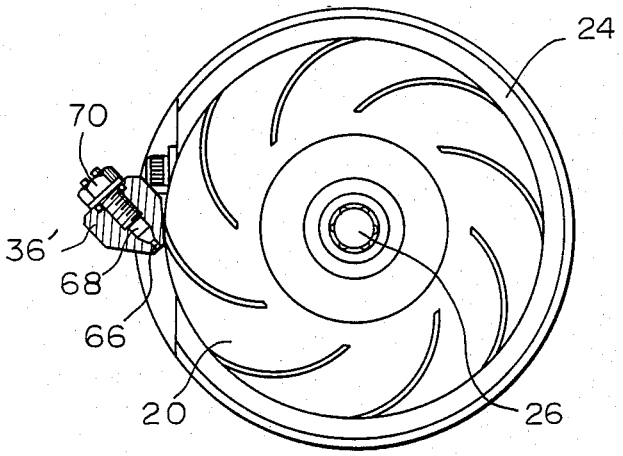
FIG. 3 is a partly sectional bottom plan of the cleaning apparatus showing another embodiment of the present invention.

As shown in FIG. 3, the replaceable nozzle 38 may be substituted by a nozzle housing 36' with a nozzle needle 68 mounted to the stationary disc 12. The nozzle housing 36' is formed with a nozzle hole 66 in which the nozzle needle 68 is slidably received. A bolt 70 is manipulatable to move the nozzle needle 68 relative to the nozzle housing 36' to control the effective cross-sectional area of the nozzle hole 66 which determines the volume of ejection toward the impeller 20. The resulting effect is comparable with that discussed with reference to FIG. 2.

Now, the sealings simply relying on the O-rings 46, 56 and backup rings 48, 58 may fail to provide full liquid-tight sealing depending on the liquid pressure communicated to the corresponding passageways. This would limit the permissible pressure of ejection from the nozzles 62 and 64 which in turns would limit the cleaning efficiency of the apparatus. In detail, where an O-ring is interposed between associated sliding surfaces, it is caused to rotate (slide) relative to either one of the sliding surfaces and the resulting deterioration to the sealing function cannot be compensated for by backup rings.

Figure 4:
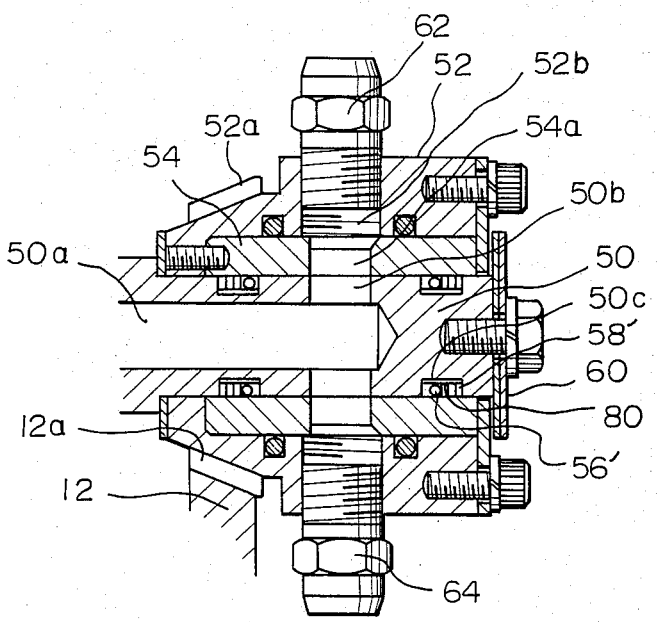
FIG. 4 is a fragmentary section of an ejector assembly of the cleaning apparatus shown in FIG. 1 but indicating an improved sealing.
Figure 5:
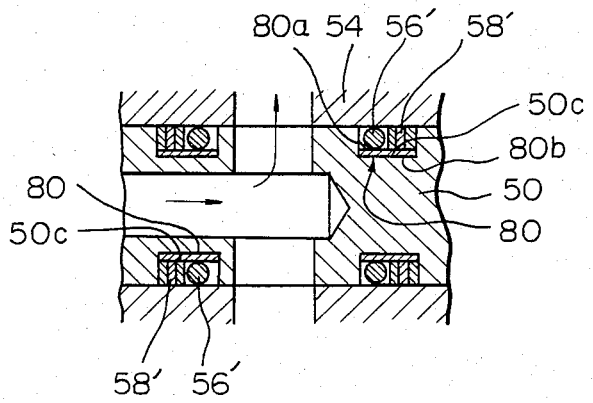
FIG. 5 is an enlarged fragmentary section of the ejector assembly shown in FIG. 4.

Referring to FIGS. 4 and 5, an improved version of the sealing which is desirable for settling the above problem is illustrated. The improved sealing will be described taking the transverse shaft 50 and the housing 52 for example.

In FIGS. 4 and 5, the sealing comprises a strip made of a material whose coefficient of friction is small, in addition to an O-ring 56' and a plurality of backup rings 58' which are similar to those shown in FIG. 1. The strip 80 is wound on the bottom of the annular recess 50*c* throughout the circumference and substantially identical in width as the latter. The material of the strip 80 is substantially common to that of the sleeve 54, e.g. high molecular polyethylene. With this arrangement, the strip 80 is free to rotate (slide) relative to the bottom of the annular recess 50*c*. The O-ring 56' and backup rings 58' are coupled side by side on the radially outer surface 80*a* of the strip 80.

Figure 6:
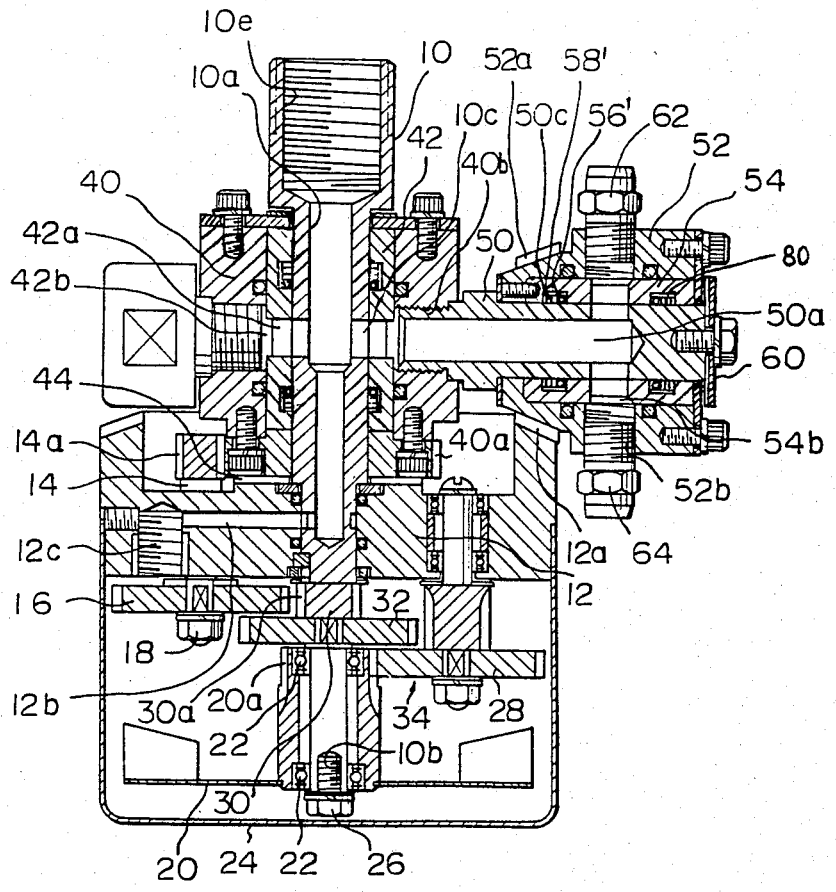
FIG. 6 is a section of a cleaning apparatus for an enclosure similar to FIG. 1 but showing an alternate arrangement regarding the sealing.

It will be apparent that the sealing shown in FIGS. 4 and 5 is also applicable to the shaft 10 and vertical housing 40 as shown in FIG. 6.

In operation, the liquid under pressure reaching the annular recess 54*a* of the sleeve 54 tends to leak axially through the interface between the sleeve 54 and the shaft 50. This tendency is effectively checked by the O-ring 56' and backup rings 58' with the aid of the strip or slipper sheet 80. In detail, the O-ring 56' and backup rings 58' are held between the sliding surface of the sleeve 54 and the radially outer surface 80*a* of the slipper sheet 80 and rotated together with the sleeve 54, while having their inner and outer peripheries prevented from sliding relative thereto. Such a sealing function is comparable with one provided by ordinary sealings between interengaged stationary members. Accordingly, liquid-tight sealing is ensured between the sliding surface though the liquid pressure communicated to the passageway may be raised to a substantial level.

The liquid in the annular recess 54*a* may accidentally penetrate into between the radially inner surface 80*b* of the slipper sheet 80 and the bottom of the annular recess 50*c*. However, this results only a minimum of leakage because the slipper sheet 80 has a predetermined axial width.

In summary, it will be seen that the present invention provides a cleaning apparatus which can be driven at a speed optimum for a specific application with the pressure of cleaning jets controlled to a desired value. Furthermore, the cleaning apparatus allows O-rings to fully exhibit their expected functions to attain unprecedented liquid-tight sealing.

Various modifications will become possible for those skilled in the art after receiving the teachings of the present disclosure without departing from the scope thereof. For example, the sleeve 54 may be formed with an annular recess to receive a slipper sheet, an O-ring and backup rings in the manner described. In such a case, the shaft 50 should be made of a material having a low friction coefficient. The sealing arrangement shown and described is applicable to any other type of rotary shaft and its associated element.

What is claimed is:

1. A cleaning apparatus for an enclosure comprising:

a stationary support member having a first ejection port;

a first shaft securely mounted to the support member and formed with a first axial bore from one end toward the other end;

an impeller journaled to said other end of the first shaft adjacent to the first ejection port;

a first distribution path branching off the first axial bore in the first shaft to distribute to the first ejection port liquid under high pressure communicated from a source of pressurized liquid supply to the first axial bore;

a first hollow cylindrical member supported on the support member to be rotatable about a longitudinal axis of the first shaft, said first cylindrical member having a first sleeve slidably engaging the first shaft;

a second shaft fixedly connected to the first cylindrical member such that a longitudinal axis thereof extends perpendicularly to the axis of the first shaft;

an ejector assembly rotatably mounted on the second shaft and having at least one second ejection port therein and a second sleeve engaged with the second shaft;

a second distribution path branching off the first axial bore in the first shaft to distribute to the second ejection port in the ejector assembly the liquid under high pressure communicated from the source of pressurized liquid supply to the first axial bore;

transmission means for transmitting rotation of the impeller to the first cylindrical member to cause the ejector assembly to revolve about the axis of the first shaft through the first cylindrical member and the second shaft;

means for causing the ejector assembly to rotate about the axis of the second shaft simultaneously with the revolution around the axis of the first shaft;

ejection control means for controlling the pressure of the driving jet to a desired value, regardless of the pressure of the cleaning jet, said ejection control means including a nozzle housing securely mounted to the first ejection port of the support member, said nozzle housing having a nozzle hole and an adjustable nozzle needle in the nozzle hole, and sealing means interposed between the first sleeve on the first cylindrical member and the first shaft and between the second sleeve of the ejector assembly and the second shaft, each of the sealing means comprising an annular flat strip made of a material having a low friction coefficient and wound on the bottom of a first annular recess which is formed in the outer periphery of the shaft, an O-ring and a plurality of backup rings which are coupled side by side on the flat strip in the first annular recess;

whereby the liquid from the source of pressurized liquid supply is ejected from the first ejection port of the support member as a driving jet for driving the impeller and from the second ejection port of the ejector assembly as a cleaning jet for cleaning the interior of the enclosure.

2. An apparatus as claimed in claim 1, in which the transmission means comprises a gearing between the impeller and the first cylindrical member.

3. An apparatus as claimed in claim 1, in which the means for causing the ejector assembly into rotation comprises bevelled teeth formed on the support member and bevelled teeth formed on the ejector assembly which mesh with the bevelled teeth on the support member.

4. An apparatus as claimed in claim 1, in which the first distribution path is defined by a first radial passageway formed in the support member to communicate at one end with the axial bore in the first shaft and the other end of the first radial passageway communicates with one end of a second bore, and the other end of the second bore is communicated with the first ejection port in the support member.

5. An apparatus as claimed in claim 1, in which the second sleeve is rotatably mounted on the second shaft and a second hollow cylindrical member is fastened to the second sleeve, the second distribution path being defined by first holes formed throughout a circumferential wall of the first shaft in communication with the first axial bore, a second annular recess formed in an inner periphery of the first sleeve, second holes in the first sleeve contiguous with the second annular recess, a second axial bore extending through the second shaft, second radial passageways in the second shaft contiguous with the second axial bore, a third annular recess in the inner periphery of the second sleeve communicated with the second radial passageways in the second shaft, third holes formed through the second sleeve contiguous with the third annular recess which terminates at the second ejection port of the ejector assembly located in the second cylindrical member.

6. An apparatus as claimed in claim 5, in which the means for causing the ejector assembly into rotation comprises bevelled teeth formed on the support member and bevelled teeth formed on the second cylindrical member of the ejector assembly which mesh with the bevelled teeth on the support member.

7. An apparatus as claimed in claim 1, in which a nozzle is fitted to the second ejection port of the ejector assembly.

8. A cleaning apparatus for an enclosure comprising:

a stationary support member having upper and bottom surfaces, teeth circularly arranged on the upper surface, ejection means connected beneath the bottom surface, and a first distribution path extending from the center thereof to the ejection means;

a first shaft, immovably connected to the center of the support member, which extends perpendicularly upward from the support member, said first shaft having an axial bore extending from an upper end to a lower portion which communicates with the first distribution path in the support member, and said first shaft having at least one side hole;

an impeller rotationally connected to the support member adjacent to the ejection means so that the impeller can rotate by fluid flowing from the axial bore and ejected through the ejection means;

a rotational shaft rotationally supported in the support member, said rotational shaft having an upper gear head on the upper surface of the support member and a lower gear head connected to the impeller so that when the impeller rotates, the rotational shaft rotates;

a rotatable housing situated around the first shaft, said rotatable housing having a gear on the lower portion thereof engaging the upper gear head of the rotational shaft so that when the rotational shaft rotates, the housing rotates around the first shaft, and a second shaft connected to the housing perpendicularly to the first shaft, said second shaft having a second distribution path communicating with the axial bore of the first shaft through the side hole of the first shaft, and a transverse housing rotationally disposed on the second shaft, said transverse housing having teeth therearound to engage the teeth on the support member, and at least one nozzle on the transverse housing, said nozzle communicating with the second distribution path so that when the rotatable housing is rotated around the first shaft by means of the rotational shaft, and the impeller actuated by fluid ejected through the ejection means, the transverse housing rotates around the second shaft and pressurized fluid is ejected from the nozzle to clean the interior of the enclosure.

9. An apparatus as claimed in claim 8, in which said ejection means having a selected diameter is replaceably fitted to the support member.

10. An apparatus as claimed in claim 8, in which said ejection means comprises a nozzle housing securely mounted to the support member, said nozzle housing having a nozzle hole and an adjsutable nozzle needle in the nozzle hole.

11. An apparatus as claimed in claim 8 further comprising transmission means between the impeller and the rotational shaft.

12. An apparatus as claimed in claim 8, in which the rotatable housing includes a first sleeve slidably engaged with the first shaft, and the transverse housing includes a second sleeve slidably engaged with the second shaft.

13. An apparatus as claimed in claim 12 further comprising sealing means interposed between the first sleeve on the rotatable housing and the first shaft and between the second sleeve of the transverse housing and the second shaft, each of the sealing means comprising an annular flat strip made of a material having a low friction coefficient and wound on a bottom of an annular recess which is formed in the outer periphery of the shaft, an O-ring and a plurality of backup rings which are coupled side by side on the flat strip in the annular recess.

14. An apparatus as claimed in claim 8, in which the first distribution path is defined by a radial passageway formed in the support member to which communicates at one end with the axial bore in the first shaft, and at the other end with the ejection means.

15. A cleaning apparatus for an enclosure comprising:

a stationary support member having a first ejection port;

a first shaft securely mounted to the support member and formed with a first axial bore from one end toward the other end;

an impeller journalled to said other end of the first shaft adjacent to the first ejection port;

a first distribution path branching off the first axial bore in the first shaft to distribute to the first ejection port liquid under high pressure communicated from a source of pressurized liquid supply to the first axial bore;

a first hollow cylindrical member supported on the support member to be rotatable about a longitudinal axis of the first shaft, said first cylindrical member having a first sleeve slidably engaging the first shaft;

a second shaft fixedly connected to the first cylindrical member such that a longitudinal axis thereof extends perpendicularly to the axis of the first shaft;

an ejector assembly rotatably mounted on the second shaft and having at least one second ejection port therein and a second sleeve engaged with the second shaft;

a second distribution path branching off the first axial bore in the first shaft to distribute to the second ejection port in the ejector assembly the liquid under high pressure communicated from the source of pressurized liquid supply to the first axial bore;

transmission means for transmitting rotation of the impeller to the first cylindrical member to cause the ejector assembly to revolve about the axis of the first shaft through the first cylindrical member and the second shaft;

means for causing the ejector assembly to rotate about the axis of the second shaft simultaneously with the revolution around the axis of the first shaft;

ejection control means for controlling the pressure of the driving jet to a desired value, regardless of the pressure of the cleaning jet, said ejection control means including a nozzle housing securely mounted to the first ejection port of the support member, said nozzle housing having a nozzle hole and an adjustable nozzle needle in the nozzle hole, and sealing means interposed between the first sleeve on the first cylindrical member and the first shaft and between the second sleeve of the ejector assembly and the second shaft, each of the sealing means comprising an annular flat strip made of a material having a low friction coefficient and wound on the bottom of a first annular recess which is formed in the inner periphery of the sleeve, an O-ring and a plurality of backup rings which are coupled side by side on the flat strip in the first annular recess;

whereby the liquid from the source of pressurized liquid supply is ejected from the first ejection port of the support member as a driving jet for driving the impeller and from the second ejection port of the ejector assembly as a cleaning jet for cleaning the interior of the enclosure.

16. An apparatus as claimed in claim 15 further comprising sealing means interposed between the first sleeve on the rotatable housing and the first shaft and between the second sleeve of the transverse housing and the second shaft, each of the sealing means comprising an annular flat strip made of a material having a low friction coefficient and wound on a bottom of an annular recess which is formed in the inner periphery of the sleeve, an O-ring and a plurality of backup rings which are coupled side by side on the flat strip in the annular recess.

* * * * *